US009302172B2

(12) United States Patent
Kim

(10) Patent No.: US 9,302,172 B2
(45) Date of Patent: Apr. 5, 2016

(54) INLINE SKATE INCLUDING A WHEEL-DRIVING UNIT

(75) Inventor: Ji Hoon Kim, Daejeon (KR)

(73) Assignee: HAPPYLIFE CO., LTD, Daejeon (KR)

( * ) Notice: Subject to any disclaimer, the term of this patent is extended or adjusted under 35 U.S.C. 154(b) by 0 days.

(21) Appl. No.: 13/510,911

(22) PCT Filed: Aug. 23, 2011

(86) PCT No.: PCT/KR2011/006228

§ 371 (c)(1),
(2), (4) Date: May 18, 2012

(87) PCT Pub. No.: WO2012/033294

PCT Pub. Date: Mar. 15, 2012

(65) Prior Publication Data

US 2012/0228045 A1 Sep. 13, 2012

(30) Foreign Application Priority Data

Sep. 7, 2010 (KR) ..... 10-2010-0087422

(51) Int. Cl.
*A63C 17/12* (2006.01)
*A63C 17/06* (2006.01)

(52) U.S. Cl.
CPC ..... *A63C 17/12* (2013.01); *A63C 17/065* (2013.01)

(58) Field of Classification Search
USPC ..... 280/841, 11.19, 11.201, 11.204, 280/11.208, 11.211, 11.214, 11.215, 280/11.216, 11.217, 11.221, 11.231, 200, 280/210, 11.115, 11.224, 11.225, 11.232; 180/205.1, 206.8
See application file for complete search history.

(56) References Cited

U.S. PATENT DOCUMENTS

| | | | | | |
|---|---|---|---|---|---|
| 602,704 | A | * | 4/1898 | Kinsbruner | 280/11.115 |
| 619,370 | A | * | 2/1899 | Wagner | 280/11.115 |
| 674,096 | A | * | 5/1901 | Pease | 280/11.115 |
| 732,120 | A | * | 6/1903 | Schmidt | 280/11.115 |
| 903,525 | A | * | 11/1908 | Wellnitz | 280/11.115 |
| 942,333 | A | * | 12/1909 | Lennox | 280/11.115 |
| 968,517 | A | * | 8/1910 | Pierman | 280/11.115 |
| 999,660 | A | * | 8/1911 | Koppel | 280/11.115 |
| 1,208,173 | A | * | 12/1916 | Lenhardt | 280/11.115 |
| 1,338,813 | A | * | 5/1920 | Chiarelli | 280/11.115 |
| 1,437,314 | A | * | 11/1922 | Jorgensen | 280/11.115 |
| 1,924,948 | A | * | 8/1933 | Lieberenz | 280/11.115 |
| 2,536,569 | A | | 1/1951 | Purkey | |
| 4,602,801 | A | * | 7/1986 | Vincent | 280/11.115 |
| 4,691,931 | A | * | 9/1987 | Vincent | 280/11.115 |
| 4,706,974 | A | | 11/1987 | Vincent | |

(Continued)

FOREIGN PATENT DOCUMENTS

| | | | |
|---|---|---|---|
| AU | 748459 | B2 | 5/1999 |
| DE | 129372 | C | 4/1902 |

(Continued)

*Primary Examiner* — John Walters
*Assistant Examiner* — Brian Swenson
(74) *Attorney, Agent, or Firm* — AKC Patents, LLC; Aliki K. Collins

(57) ABSTRACT

An inline skate including a wheel-driving unit which generates power when a foot pushes on the ground to rotate the wheels, and when the boot is lifted, the frame is spaced apart from the ground to further increase the time required for stepping forward on the ground or being pushed from the ground, thereby obtaining propulsive force such that the inline skate quickly advances.

4 Claims, 8 Drawing Sheets

(56) References Cited

U.S. PATENT DOCUMENTS

| | | | | |
|---|---|---|---|---|
| 5,382,052 | A | 1/1995 | Tarng | |
| 5,492,345 | A * | 2/1996 | Kruczek | 280/11.115 |
| 6,237,923 | B1 * | 5/2001 | Fowle | 280/11.115 |
| 7,300,065 | B2 * | 11/2007 | Tal | 280/221 |
| 7,367,569 | B2 * | 5/2008 | Viitamaki | 280/11.115 |
| 7,568,706 | B2 * | 8/2009 | Ng et al. | 280/11.115 |
| 2008/0061521 | A1 | 3/2008 | Ng | |
| 2010/0207348 | A1 | 8/2010 | Othman | |

FOREIGN PATENT DOCUMENTS

| | | | |
|---|---|---|---|
| JP | 08-164234 | A | 6/1996 |
| WO | 03-084621 | A1 | 10/2003 |
| WO | 2007-042773 | A2 | 4/2007 |

* cited by examiner

INLINE SKATE INCLUDING A WHEEL-DRIVING UNIT

RELATED APPLICATIONS

This application is a 371 application of International Application No. PCT/KR2011/006228, filed Aug. 23, 2011, which in turn claims priority from Korean Patent Application No. 10-2010-0087422, filed Sep. 7, 2010, each of which is incorporated herein by reference in its entirety.

TECHNICAL FIELD

The present invention relates to an inline skate, and more particularly, to an inline skate including a wheel-driving unit which generates power when a foot pushes on the ground to rotate the wheels, and when the boot is lifted, the frame is spaced apart from the bottom surface of the boot to further increase the time required for stepping forward on the ground or being pushed from the ground, thereby obtaining propulsive force such that the inline skate quickly advances.

BACKGROUND ART

Inline skate is a kind of a roller skate, and has a boot with several wheels attached in a row thereto. Inline skating is known to be an excellent aerobic activity and has great health improvement effect. As inline skating improves balance and enhances physical strength, it is widely enjoyed by all ages and gender.

Unlike bicycle, the inline skate is portable and may be easily worn and enjoyed anytime and anywhere, is faster than walking and thus is widely used as transportation means by young people.

However, traditional inline skate drives wheels by leg motion of humans and is slow and requires more power to increase the speed.

To solve the foregoing problem, there has been developed an inline skate which drives wheels by electric motor and batteries. In this case, a user should frequently replace the batteries and feels difficult to manipulate an operation switch of the electric motor attached to the boot while in use and may overbalance and fall at the time of initial driving. This causes a safety problem.

DISCLOSURE

Technical Problem

The present invention has been made to solve the problems and it is an object of the present invention to provide an inline skate including a wheel-driving unit which generates power without an electric power unit such as an additional motor when a foot pushes on the ground to rotate the wheels, and when the boot is lifted, the frame is spaced apart from the bottom surface of the boot to further increase the time required for stepping forward on the ground or being pushed from the ground, thereby obtaining propulsive force such that the inline skate quickly advances.

Technical Solution

In order to achieve the object of the present invention, an inline skate includes a boot and a frame, on which a plurality of wheels are installed, on a bottom surface of the boot.

One side end of the bottom surface of the boot is hingedly coupled to an upper end of the frame, and one end of a link is hingedly coupled to the other side of the bottom surface of the boot.

A driving gear is disposed on one end of the frame and a connection gear is coaxially disposed on one wheel of the plurality of wheels installed on the frame, and is engaged with the driving gear to thereby be rotated.

A driving unit for rotating the driving gear is disposed on the other end of the link.

The driving unit comprises a guide groove which is disposed on one end of the frame so that the other end of the link moves in a lengthwise direction of the frame;

a pulley which is coaxially disposed on the driving gear and has a one-way clutch mounted thereon;

an elastic body which is installed in the frame; and a wire whose opposite ends are fixed to the other end of the link and the elastic body and whose one end is wound to the pulley.

The driving unit includes a guide groove which is disposed on one end of the frame so that the other end of the link moves in a lengthwise direction of the frame;

A sprocket which is coaxially disposed on the driving gear and has a one-way clutch mounted thereon;

An elastic body which is installed in the frame; and

A wire which is connected to the other end of the link and the elastic body at opposite ends of a chain which is connected to the sprocket.

The driving unit includes a crank shaft which is axially coupled to the other end of the link to be rotated and has one end connected to the driving gear; and A one-way clutch which is mounted in either the driving gear or the connection gear and transmits one-way rotation of the crank shaft to the wheels.

A hinge spring is further disposed on a point where the boot and the frame are hingedly coupled to each other.

An inline skate includes a boot and a frame, on which a plurality of wheels are installed, on a bottom surface of the boot.

An elastic body is disposed between the frame and the boot to maintain a consistent gap therebetween and one end of a link is hingedly coupled to the bottom surface of the boot.

A crank shaft is disposed to axially coupled to the other end of the link to be rotated and has one end connected to a driving sprocket.

A connection sprocket is coaxially disposed on one wheel of the plurality of wheels installed on the frame, and is connected to the driving sprocket by a chain to thereby be rotated.

A one-way clutch is mounted in either the driving sprocket or the connection sprocket and transmits a one-way rotation of the crank shaft to the wheels.

The elastic body includes one of a coil spring, a plate spring and a shock absorber.

Other purposes and effects of the present invention will become apparent from the explanation as provided below, and the explanation on exemplary embodiments of the present invention and the exemplary embodiments do not limit the scope of the present invention thereto.

Advantageous Effect

As described above, an inline skate including a wheel-driving unit according to the present invention generates power without an electric power unit such as an additional motor when a foot pushes on the ground to rotate the wheels, and when the boot is lifted, the frame is spaced apart from the bottom surface of the boot to further increase the time required for stepping forward on the ground or being pushed from the ground, thereby obtaining propulsive force such that the inline skate quickly advances.

BEST MODE

Figure 1:
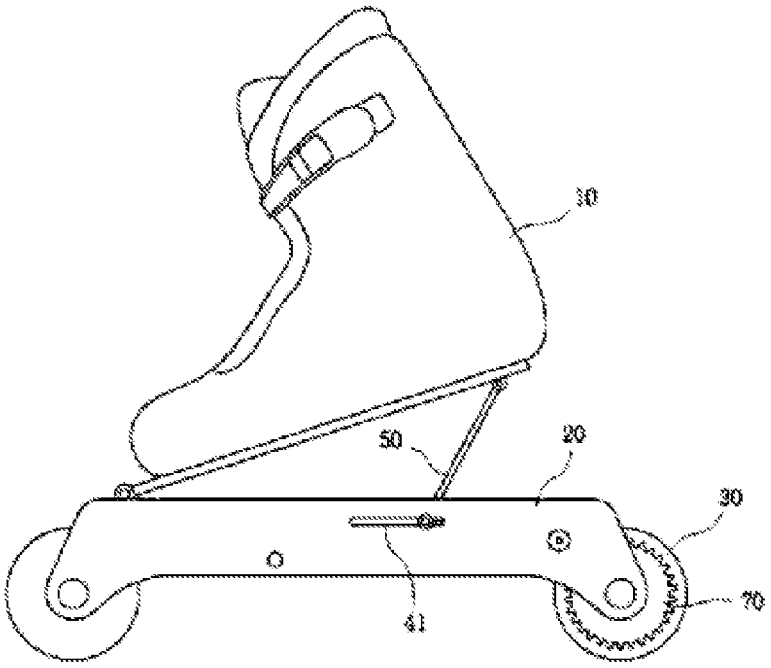
FIG. 1 is a lateral view of an inline skate including a wheel-driving unit according to the present invention.

Below, exemplary embodiments according to the present invention will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

Figure 2:
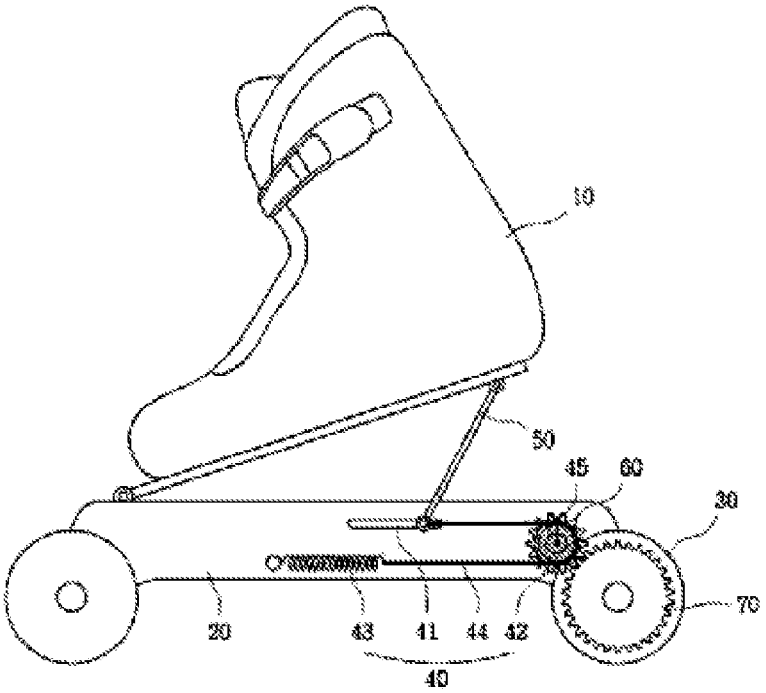
FIG. 2 is a lateral sectional view of the inline skate in FIG. 1.
Figure 3:
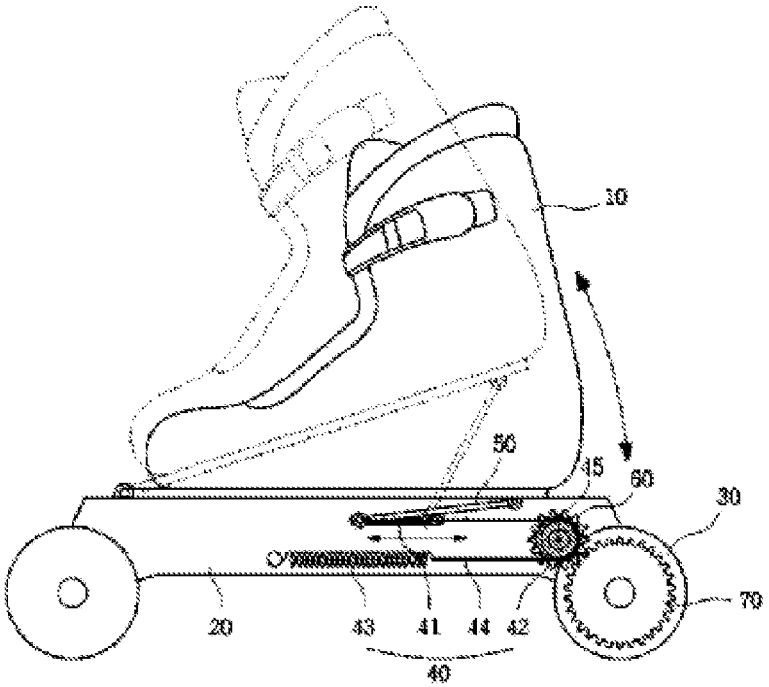
FIG. 3 is a plan view showing an operation state of the inline skate including the wheel-driving unit according to the present invention.
Figure 4A:
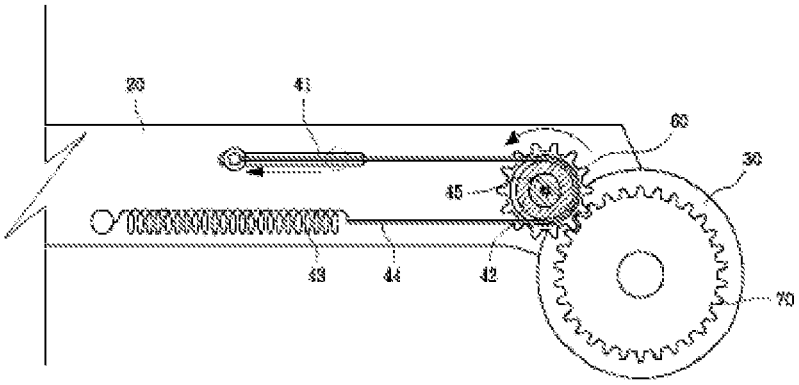
FIGS. 4*a* and 4*b* illustrate an operation state of the driving unit which applies to the present invention.
Figure 4B:
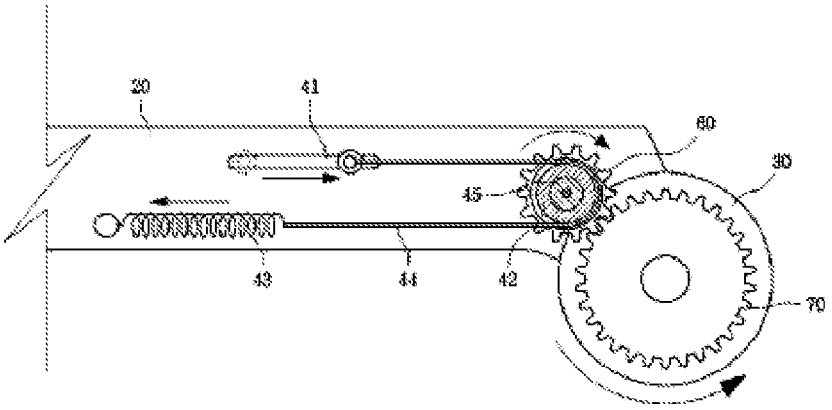
Figure 5:
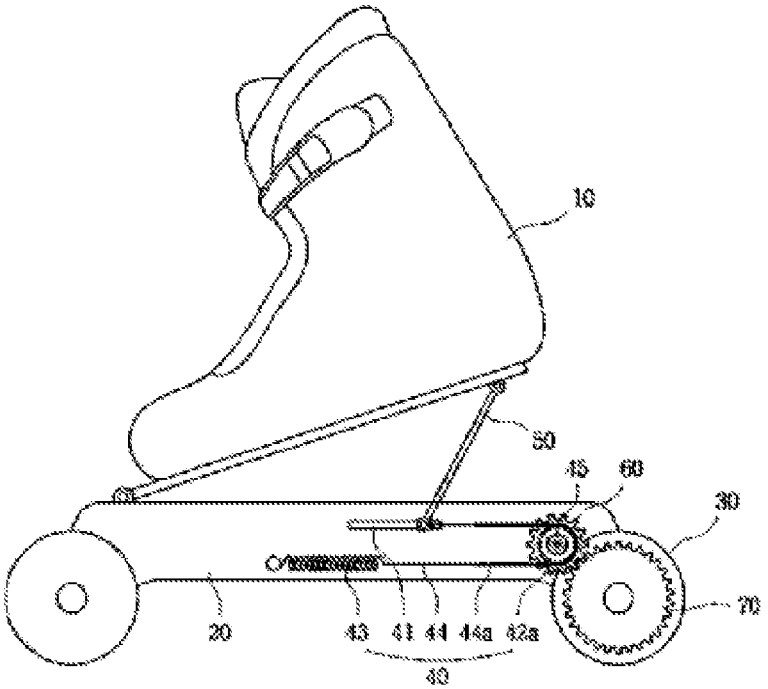
FIG. 5 illustrates a driving unit to which a sprocket and a chain apply.
Figure 6:
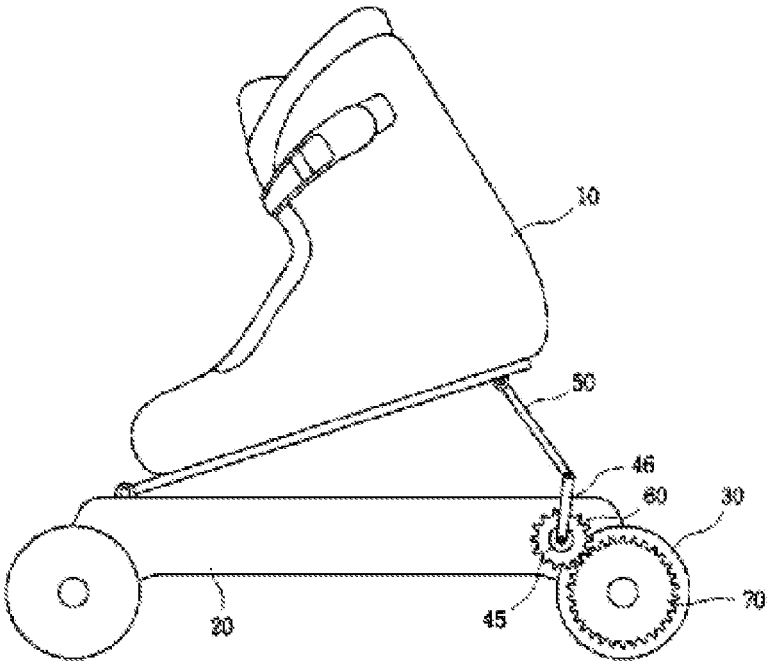
FIG. 6 illustrates a wheel-driving unit according to another exemplary embodiment of the present invention.
Figure 7:
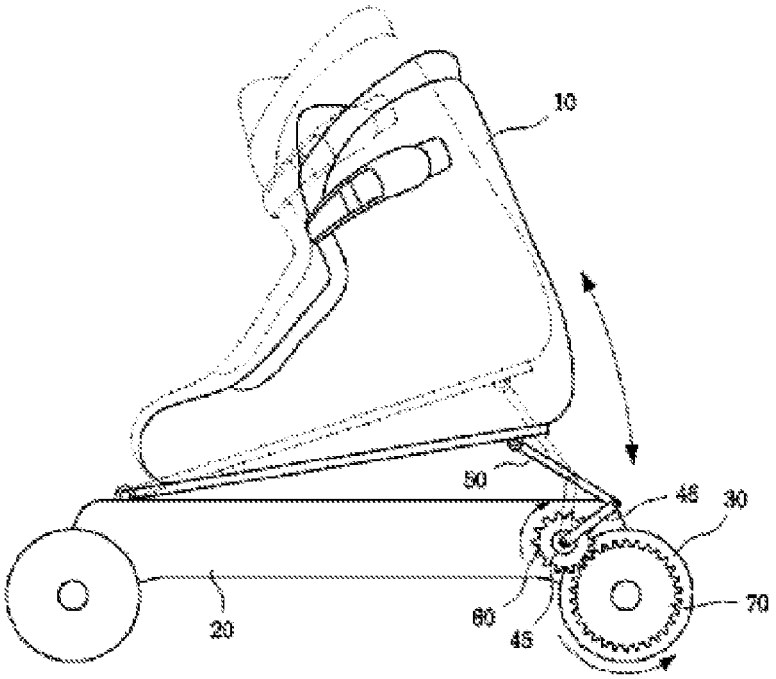
FIG. 7 illustrates an operate state of the wheel-driving unit in FIG. 6.
Figure 8A:
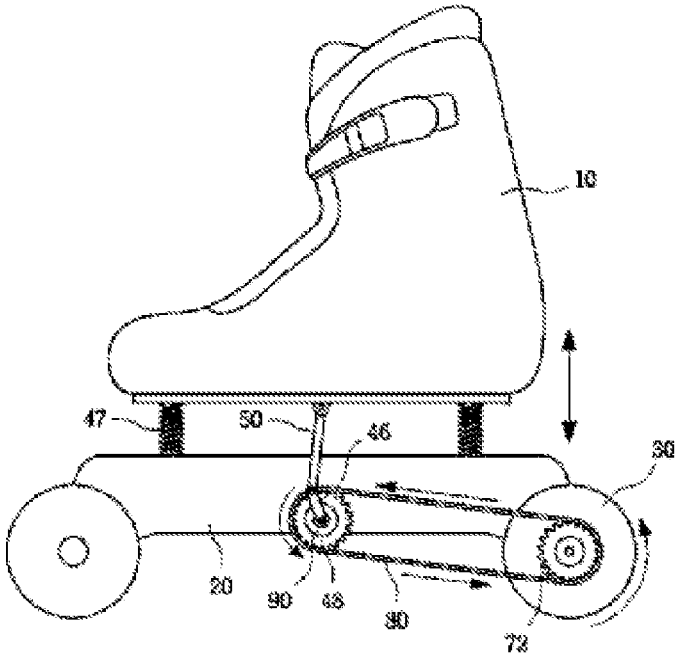
FIGS. 8*a* and 8*b* illustrate an inline skate including a wheel-driving unit according to another exemplary embodiment of the present invention.
Figure 8B:
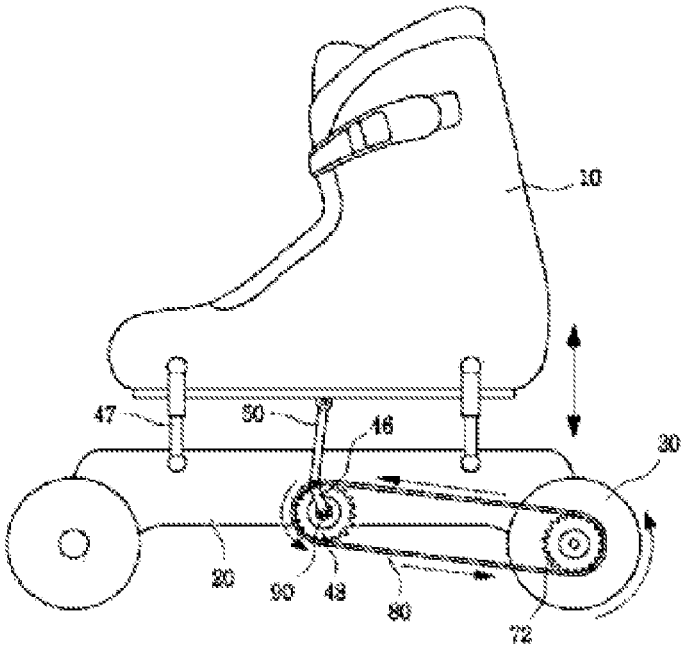

FIG. 1 is a lateral view of an inline skate including a wheel-driving unit according to the present invention. FIG. 2 is a lateral sectional view of the inline skate in FIG. 1. FIG. 3 is a plan view showing an operation state of the inline skate including the wheel-driving unit according to the present invention. FIGS. 4*a* and 4*b* illustrate an operation state of the driving unit which applies to the present invention. FIG. 5 illustrates a driving unit to which a sprocket and a chain apply. FIG. 6 illustrates a wheel-driving unit according to another exemplary embodiment of the present invention. FIG. 7 illustrates an operate state of the wheel-driving unit in FIG. 6. FIGS. 8*a* and 8*b* illustrate an inline skate including a wheel-driving unit according to another exemplary embodiment of the present invention.

In the present invention, the front side means the direction in which the inline skate advances and the rear side means the opposite direction of the front side.

Referring to FIGS. 1 to 4*b*, an inline skate including a wheel-driving unit according to the present invention includes a boot, a frame 20 on which a plurality of wheels 30 are installed, on the bottom surface of the boot 10, and a driving unit 40 which transmits power to the wheels 30.

One side end of the bottom surface of the boot is hingedly coupled to an upper end of the frame 20.

Like a typical clap skate, in the inline skate according to the present invention, a front end of the boot 10 is preferably hingedly coupled to the frame 20, and a heel of the boot 10 is spaced apart from the frame 20 when boot 10 is lifted.

A hinge spring 22 is further installed in a hinge shaft which is hingedly coupled to the boot 10 and the frame 20, and thus the frame 20 which contacts the heel of the boot 10 when the foot pushes on the ground is spaced apart from the heel when the boot 10 is lifted.

Such operation is performed to obtain propulsive force by increasing the time required for stepping forward on the ground and being pushed from the ground by the wheels 30.

To obtain stronger propulsive force by rotating the wheels 10 with the rotation of the heel of the boot 10 centering on the hinge point of the boot 10 and the frame 20, the inline skate further includes a link 50 which is hingedly coupled to the other side of the bottom surface of the boot 10, a driving gear 60 which is disposed on one end of the frame 20, a connection gear 70 which is coaxially disposed on the wheels 10 and engaged with the driving gear 60 to thereby be rotated, and a driving unit 40 which connects the link 50 and the driving gear 60.

The driving unit 40 converts a motion of the link 50 by the motion of the boot 10 hingedly coupled to the frame 20 into a rotation and transmits the rotation to the driving gear 60. The driving unit 40 includes a guide groove 41, a pulley 42, an elastic body 43 and a wire 44.

The guide groove 41 is disposed on one end of the frame 20 so that the other end of the link 50 reciprocates back and forth in a lengthwise direction of the frame 20 by the motion of the boot 10.

The wire 44 has opposite ends fixed to the other end of the link 50 and the elastic body 43 installed in the frame 20, and has one end wound to the pulley 42 disposed coaxially on the driving gear 60.

As shown in FIGS. 4*a* and 4*b*, if the other end of the link 50 moves in the front side along the guide groove 41, the wire 44 is pulled. When the boot 10 is lifted again, the other end of the link moves in the rear side by the hinge spring 22 and the elastic body 43 and rotates the pulley 42 to thereby rotate the driving gear 60.

As in FIG. 4*a*, a one-way clutch 45 is mounted in the pulley 42 to prevent a reverse rotation of the wheels 10 when the other end of the link 50 moves in the front side and pulls the wire 44 and rotates the pulley 42.

Referring to FIG. 5, a sprocket 42*a* may be used instead of the pulley 42 coaxially disposed on the driving gear 60, and a chain 44*a* may be disposed on one end of the wire 44 to be wound to the sprocket 42*a*.

Referring to FIGS. 6 and 7, a driving unit 40 according to another exemplary embodiment of the present invention is axially coupled to the other end of the link 50 to be rotated and has a crank shaft 46 formed in one end thereof and connected to the driving gear 60, and converts a motion of the link 50 by the motion of the boot 10 hingedly coupled to the frame 20 into a rotation through crank shaft 46 and transmits the rotation to the driving gear 60.

A one-way clutch 45 is mounted in either the driving gear 60 or the connection gear 70 not to transmit the reverse rotation of the crank shaft 46 to the wheels 30 to rotate the wheels 30 only in the direction in which the inline skate advances.

Hereinafter, an inline skate including a driving unit according to another exemplary embodiment of the present invention will be described.

Referring to FIGS. 8*a* and 8*b*, an elastic body 47 is disposed between the boot 10 and the frame 20 to maintain a consistent gap therebetween, and thus the boot 10 and the frame 20 are even.

The elastic body 47 includes one of a coil spring in FIG. 8*a* and a shock absorber and a plate spring in FIG. 8*b*.

The elastic body 47 increases the time required for stepping forward on the ground or being pushed from the ground as well as absorbing the shock given to the feet of a user.

One end of the link 50 is hingedly coupled to the bottom surface of the boot 10, and the crank shaft 46 is axially coupled to the other end of the link 50 to be rotated.

A driving sprocket 48 is connected to one end of the crank shaft 46 and a connection sprocket 72 is coaxially disposed on the wheels 30 installed on the frame 20. To transmit the rotational force of the driving sprocket 48 which rotates by the rotation of the crank shaft 46 to the wheels 30, the driving sprocket 48 and the connection sprocket 72 are connected to each other by a chain 80.

A one-way clutch 90 may be installed in either the driving sprocket 48 or the connection sprocket 72 not to transmit the reverse rotation of the crank shaft 46 to the wheels 30.

According to the present invention, the rotational force which is transmitted to the wheels 30 may be voluntarily increased or decreased depending on a gear ratio of the driving gear 60 and the connection gear 70 and the size of the driving sprocket 48 and the connection sprocket 72.

That is, as explained above, the inline skate including the wheel-driving unit according to the present invention may rotate the wheels 30 to increase the propulsive force when a user pushes the ground with the wheels 30, and when the boot 10 is lifted, the frame 20 is spaced apart from the bottom surface of the boot 10 and the time required for stepping forward on the ground or being pushed from the ground and the propulsive force is further obtained.

Although a few exemplary embodiments have been shown and described, it will be appreciated by those skilled in the art that changes may be made in these exemplary embodiments without departing from the principles and spirit of the invention, the range of which is defined in the appended claims and their equivalents.

DESCRIPTION OF REFERENCE NUMERALS

10: boot 20: frame
22: hinge spring 30: wheels
40: driving unit 41: guide groove
42: pulley 42*a*: sprocket
43: elastic body 44: wire
44*a*, 80: chain 45, 90: one-way clutch
46: crank shaft 48: driving sprocket
50: link 60: driving gear
70: connection gear 72: connection sprocket

The invention claimed is:

1. An inline skate which comprises a boot and a frame, on which a plurality of wheels are installed, on a bottom surface of the boot, wherein one side end of the bottom surface of the boot is hingedly coupled to an upper end of the frame, one end of a link is hingedly coupled to the other side of the bottom surface of the boot, a driving gear is disposed on one end of the frame, a connection gear is coaxially disposed on one wheel of the plurality of wheels installed on the frame, and is engaged with the driving gear to thereby be rotated, and a driving unit for rotating the driving gear is disposed on the other end of the link, wherein the driving unit comprises a guide groove which is disposed on one end of the frame so that the other end of the link moves in a lengthwise direction of the frame; a pulley which is coaxially disposed on the driving gear and has a one-way clutch mounted thereon; an elastic body which is installed in the frame; and a wire whose opposite ends are fixed to the other end of the link and the elastic body and whose one end is wound to the pulley.

2. The inline skate according to claim 1, wherein a hinge spring is disposed on a point where the boot and the frame are hingedly coupled to each other.

3. An inline skate which comprises a boot and a frame, on which a plurality of wheels are installed, on a bottom surface of the boot, wherein one side end of the bottom surface of the boot is hingedly coupled to an upper end of the frame, one end of a link is hingedly coupled to the other side of the bottom surface of the boot, a driving gear is disposed on one end of the frame, a connection gear is coaxially disposed on one wheel of the plurality of wheels installed on the frame, and is engaged with the driving gear to thereby be rotated, and a driving unit for rotating the driving gear is disposed on the other end of the link, wherein the driving unit comprises a guide groove which is disposed on one end of the frame so that the other end of the link moves in a lengthwise direction of the frame; a sprocket which is coaxially disposed on the driving gear and has a one-way clutch mounted thereon; an elastic body which is installed in the frame; and a wire which is connected to the other end of the link and the elastic body at opposite ends of a chain which is connected to the sprocket.

4. The inline skate according to claim 3, wherein a hinge spring is disposed on a point where the boot and the frame are hingedly coupled to each other.

* * * * *